US010458713B2

(12) United States Patent
Takeda et al.

(10) Patent No.: US 10,458,713 B2
(45) Date of Patent: Oct. 29, 2019

(54) REFRIGERANT HEAT EXCHANGER

(71) Applicant: MAYEKAWA MFG. CO., LTD., Tokyo (JP)

(72) Inventors: Masato Takeda, Tokyo (JP); Yasushi Tomiyama, Tokyo (JP); Iwao Terashima, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 0 days.

(21) Appl. No.: 15/572,164

(22) PCT Filed: May 20, 2016

(86) PCT No.: PCT/JP2016/065002

§ 371 (c)(1),
(2) Date: Nov. 7, 2017

(87) PCT Pub. No.: WO2016/199562

PCT Pub. Date: Dec. 15, 2016

(65) Prior Publication Data

US 2018/0128549 A1 May 10, 2018

(30) Foreign Application Priority Data

Jun. 9, 2015 (JP) ..... 2015-116447

(51) Int. Cl.
*F28D 1/03* (2006.01)
*F28D 9/00* (2006.01)
(Continued)

(52) U.S. Cl.
CPC ..... *F28D 1/0308* (2013.01); *F28D 1/03* (2013.01); *F28D 9/00* (2013.01); *F28D 9/0006* (2013.01);
(Continued)

(58) Field of Classification Search
CPC ..... F28D 1/03; F28D 9/0006; F28D 9/0043; F28D 1/0308; F28D 9/0031;
(Continued)

(56) References Cited

U.S. PATENT DOCUMENTS

2005/0039486 A1 2/2005 Knoll
2006/0191672 A1* 8/2006 Stenhede ..... F28D 9/0006 165/145
2011/0120672 A1* 5/2011 Ringwaldt ..... F28D 3/00 165/104.14

FOREIGN PATENT DOCUMENTS

JP 2000081289 3/2000
JP 2000081289 A * 3/2000
(Continued)

OTHER PUBLICATIONS

"Office Action of Japan Counterpart Application," dated Jan. 26, 2018,with English translation thereof, p. 1-p. 8.
(Continued)

*Primary Examiner* — David J Teitelbaum
*Assistant Examiner* — Martha Tadesse
(74) *Attorney, Agent, or Firm* — JCIPRNET

(57) ABSTRACT

A refrigerant heat exchanger is provided and includes: a hollow container having a cylindrical shape; a plate stack disposed on an inner lower side of the hollow container, including plates each having a front side and a back side with a plurality of concavo-convex portions formed thereon which are stacked to form a first heat exchange flow passage through which a first refrigerant flows and a second heat exchange flow passage through which a second refrigerant flows; a supply pipe disposed in an interior space of the hollow container above the plate stack and configured to supply the first refrigerant to the plate stack; and a discharge pipe configured to exchange heat between the first refriger-
(Continued)

ant supplied from the supply pipe and the second refrigerant flowing through the plate stack and to discharge the first refrigerant.

3 Claims, 5 Drawing Sheets

(51) Int. Cl.
*F28F 3/04* (2006.01)
*F28F 25/06* (2006.01)
*F28D 21/00* (2006.01)

(52) U.S. Cl.
CPC ..... *F28D 9/0031* (2013.01); *F28D 9/0043* (2013.01); *F28D 21/0017* (2013.01); *F28F 3/04* (2013.01); *F28F 3/042* (2013.01); *F28F 3/046* (2013.01); *F28F 25/06* (2013.01); *F25B 2339/0241* (2013.01); *F28D 2021/0064* (2013.01); *F28D 2021/0068* (2013.01)

(58) Field of Classification Search
CPC ..... F28D 2021/0064; F28D 2021/0068; F28D 9/0093; F28D 9/005; F28F 3/046
See application file for complete search history.

(56) References Cited

FOREIGN PATENT DOCUMENTS

| | | | | |
|---|---|---|---|---|
| JP | 2005515390 | | | 5/2005 |
| JP | 2006522913 | | | 10/2006 |
| JP | 2006527835 | | | 12/2006 |
| JP | 4383448 | | | 12/2009 |
| JP | 2012057900 | | | 3/2012 |
| JP | 2012-057900 | | * | 5/2012 |
| JP | 2014109408 | | | 6/2014 |
| JP | 2014109408 | A | * | 6/2014 |
| JP | 2015121396 | | | 7/2015 |
| KR | 20130101282 | A | * | 9/2013 |
| WO | 2012107645 | | | 8/2012 |

OTHER PUBLICATIONS

"International Search Report (Form PCT/ISA/210) of PCT/JP2016/065002," dated Aug. 2, 2016, with English translation thereof, pp. 1-4.
"Office Action of Korea Counterpart Application," dated Nov. 19, 2018, with English translation thereof,p. 1-p. 8.
"Office Action of China Counterpart Application," dated Nov. 2, 2018, with English translation thereof,p. 1-p. 12.
Office Action of China Counterpart Application, with English translation thereof, dated May 8, 2019, pp. 1-10.

* cited by examiner

REFRIGERANT HEAT EXCHANGER

CROSS-REFERENCE TO RELATED APPLICATION

This application is a 371 application of the international PCT application serial no. PCT/JP2016/065002, filed on May 20, 2016, which claims the priority benefits of Japan application no. 2015-116447, filed on Jun. 9, 2015. The entirety of each of the abovementioned patent applications is hereby incorporated by reference herein and made a part of this specification.

TECHNICAL FIELD

The present invention relates to a refrigerant heat exchanger for a refrigerator constituting a refrigeration cycle or the like, especially to a plate-type refrigerant heat exchanger for transmitting heat between matters in the same or different state such as gas and liquid.

BACKGROUND ART

As described in Patent Document 1, a typical refrigerant heat exchanger includes a plate stack (in the document, plate package) disposed in a lower part of an interior space of a hollow container (in the document, tank) formed into a cylindrical shape. The plate stack includes a plurality of plates (in the document, heat exchange plates) disposed adjacent to one another. The plurality of plates is disposed along the vertical direction, so as to form a first inter-plate space substantially opening into the interior space and configured so that a medium can circulate upward from the lower space of the tank to the upper space, and a second inter-plate space closed against the interior space and configured to circulate a fluid to make the medium capable of vaporizing. An outlet flow path capable of discharging the vaporized medium is formed on an upper part of the plates. An outlet for discharging the vaporized medium is disposed on an upper part of the hollow container.

The plates include an upper part, an intermediate part, and a lower part from top toward bottom, and each part is formed to have a wavy corrugation including protrusions and recesses. Actual heat exchange between the plates is performed via the intermediate part and the lower part. The wavy corrugation of the intermediate part extends in various directions at different positions of the intermediate part. The wavy corrugation extends so that the wavy corrugations of adjacent two plates intersect with each other over the entire intermediate part. With the wavy corrugations extending as described above, the rigidity of the plates is enhanced, and heat is efficiently and reliably transmitted from the fluid to the medium.

CITATION LIST

Patent Literature

Patent Document 1: JP4383448B

SUMMARY

Problems to be Solved

In the refrigerant heat exchanger disclosed in Patent Document 1, the side end portions of the plates are disposed along the inner wall surface of the hollow container. Thus, the gap between the plates and the inner wall surface of the hollow container is reduced, and it is possible to reduce the size of the hollow container. However, the wavy corrugation formed on the plates is complex. Furthermore, a plate-shaped dissipation member is inserted into the center part of the plates, extending along the stacking direction of the plates. Accordingly, the structure of the plate stack is more complicated, which may increase the production costs.

In view of the above problem of typical art, an object of the present invention is to provide a refrigerant heat exchanger including plates with a simple configuration and being capable of suppressing an increase in the production costs.

Solution to the Problems

A refrigerant heat exchanger according to some embodiments of the present invention comprises: a hollow container having a cylindrical shape; a plate stack disposed on an inner lower side of the hollow container, including plates each having a front side and a back side with a plurality of concavo-convex portions formed thereon which are stacked to form a first heat exchange flow passage through which a first refrigerant flows and a second heat exchange flow passage through which a second refrigerant flows; a supply pipe disposed in an interior space of the hollow container above the plate stack and configured to supply the first refrigerant to the plate stack; and a discharge pipe configured to exchange heat between the first refrigerant supplied from the supply pipe and the second refrigerant flowing through the plate stack and to discharge the first refrigerant. A lower side of the plates of the plate stack has a semi-circular shape along and adjacent to an inner wall surface of the hollow container. An upper side of the plates has a flattened shape having a greater curvature radius than a curvature radius of the semi-circular shape. A second introduction hole which extends in a plate-stacking direction and into which the second refrigerant is introduced is disposed in an upper portion of the plate stack, and a second lead-out hole which extends in the plate-stacking direction and from which the second refrigerant is led out is disposed in a lower portion of the plate stack. The second heat exchange flow passage is formed so as to extend and bend toward a side portion of the plates downward from the second introduction hole and to extend toward the second lead-out hole downward, in a view in the plate-stacking direction. The first heat exchange flow passage is formed so as to extend toward an end portion, with respect to a width direction, of the plates upward from the second lead-out hole, in the view in the plate-stacking direction.

According to the above refrigerant heat exchanger, the second heat exchange flow passage is configured to extend and bend toward the end portion of the plates downward from the second introduction hole, as seen in the plate-stacking direction, and to extend toward the second lead-out hole downward, while the first heat exchange flow passage is configured to extend toward the end portion, in the width direction, of the plates upward from the second lead-out hole, as seen in the plate-stacking direction. Thus, both of the first heat exchange flow passage and the second heat exchange flow passage have a simple structure. Accordingly, the structure of the refrigerant heat exchanger is simplified, and it is possible to provide a refrigerant heat exchanger capable of suppressing an increase in the production costs.

Further, according to some embodiments, the plate stack is configured such that, when the concavo-convex portions formed on respective adjacent plates are in contact with each other, the first heat exchange flow passage and the second exchange flow passage are formed by a corresponding valley between protruding portions of the adjacent concave-convex portions or by a corresponding groove inside a recessed portion.

In this case, if the concavo-convex portions are in contact when stacking adjacent plates, the corresponding first heat exchange flow passage and the second heat exchange flow passage are formed by the valley between the protruding portions of the adjacent concavo-convex portions and the grooves inside the recessed portions, which makes it possible to further facilitate production of the refrigerant heat exchanger.

Further, according to some embodiments, the second heat exchange flow passage comprises a condensing flow passage extending linearly toward the side portion of the plates downward and a discharge flow passage extending linearly toward the second lead-out hole downward. An inclination angle of an extending direction of the condensing flow passage is smaller than an inclination angle of an extending direction of the discharge flow passage.

In this case, the inclination angle of the extending direction of the condensing flow passage is smaller than the inclination angle of the extending direction of the discharge flow passage and thus the flow of the second medium supplied from the introduction hole is slow at first and gets faster in the second half. Thus, it is possible to enhance the effect to transmit heat to the first medium from the second medium, and to let the cooled second medium flow through the second lead-out hole quickly. Accordingly, it is possible to provide a refrigerant heat exchanger having a high heat-transmitting efficiency.

Further, according to some embodiments, a restriction concavo-convex portion for restricting downward movement of the second refrigerant supplied from the second introduction hole is formed below the second introduction hole formed on the plates.

In this case, the restriction concavo-convex portion for restricting downward movement of the second medium supplied from the second introduction hole is formed below the second introduction hole formed on the plate. Thus, when the plates are stacked, the restriction concavo-convex portion of a plate and the restriction concavo-convex portion of another plate come into contact and form an arc-shaped wall below the second introduction hole. Thus, it is possible to restrict downward movement of the second refrigerant supplied from the second introduction hole, and to force the flow of the second refrigerant from the second introduction hole to move outward in the width direction of the plate. Thus, it is possible to prevent in advance a flow of the second refrigerant with a low thermal conductivity that flows downward from the second introduction hole and flows into the second lead-out hole.

Advantageous Effects

According to at least some embodiments of the present invention, it is possible to provide a refrigerant heat exchanger including plates with a simple configuration and being capable of suppressing an increase in the production costs.

BRIEF DESCRIPTION OF DRAWINGS

FIG. 1A is a side view of a heat exchanger, and FIG. 1B is a cross-sectional view corresponding to the I-I arrow view of FIG. 1A.

FIG. 2A is a side view and FIG. 2B is a bottom view of the $NH_3$ introduction pipe.

FIG. 5A is a side view and FIG. 5B is a bottom view of the $NH_3$ introduction pipe.

DETAILED DESCRIPTION

Embodiments of the present invention will now be described with reference to FIG. 1A to FIG. 5B. It is intended, however, that unless particularly specified, materials, shapes, relative positions and the like of components described in the embodiments shall be interpreted as illustrative only and not intended to limit the scope of the present invention. In the present embodiment, a $CO_2$ liquefier for liquefying vaporized $CO_2$ will be described as an example of refrigerant heat exchanger.

Figure 1B:
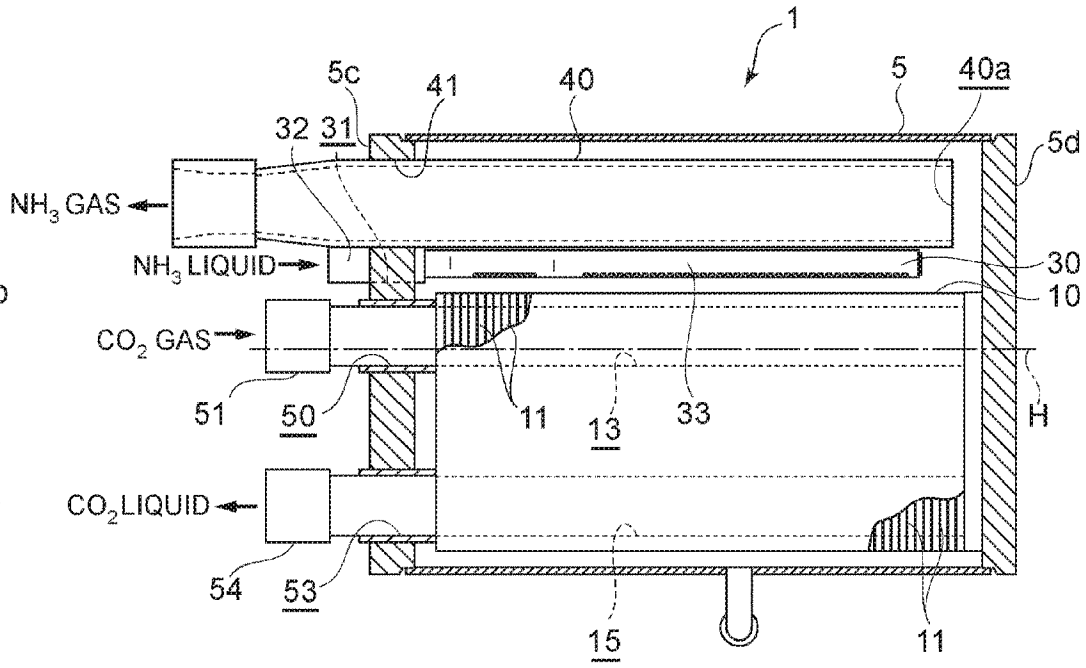
FIG. 1A and FIG. 1B are diagrams of a heat exchanger according to an embodiment of the present invention.
Figure 1A:
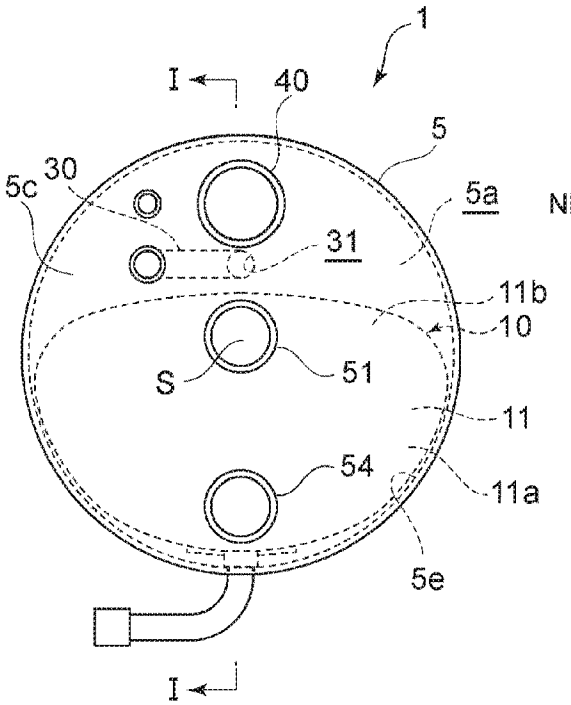

As shown in FIG. 1A and FIG. 1B, the refrigerant heat exchanger 1 constitutes a shell-and-plate heat exchanger, and is configured to exchange heat between a $NH_3$ refrigerant liquid, which is a primary refrigerant, and a $CO_2$ refrigerant gas, which is a secondary refrigerant, so that the $NH_3$ refrigerant absorbs heat from the $CO_2$ refrigerant and vaporizes, and the $CO_2$ refrigerant liquefies.

The refrigerant heat exchanger 1 includes a hollow container 5 having a cylindrical shape and a circular cross section, a plate stack 10 housed in an inner lower section of the hollow container 5, a $NH_3$ supply pipe 30 disposed in an interior space 5*a* of the hollow container 5 above the plate stack 10 for supplying the plate stack 10 with the $NH_3$ refrigerant liquid, and a $NH_3$ discharge pipe 40 for discharging a $NH_3$ gas generated from heat exchange between the $NH_3$ refrigerant liquid supplied from the $NH_3$ supply pipe 30 and a $CO_2$ gas refrigerant flowing through the plate stack 10.

The plate stack 10 is formed of a plurality of plate-shaped plates 11 stacked onto one another to have a substantially oval shape in a side view. The detail of the plate stack 10 will be described below specifically. A $NH_3$ introduction opening 31 is formed on one side, in the width direction, of the upper part of a side wall 5*c* on one end side, in the axial direction, of the hollow container 5. The $NH_3$ supply pipe 30 is inserted into the $NH_3$ introduction opening 31. The $NH_3$ supply pipe 30 includes a $NH_3$ introduction pipe 32 inserted into the $NH_3$ introduction opening 31, and a $NH_3$ spray pipe 33 connected to the tip of the $NH_3$ introduction pipe 32.

Figure 2A:
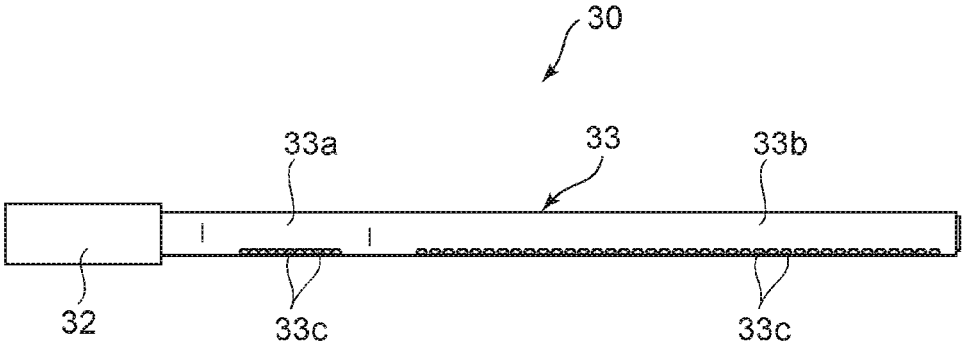
FIG. 2A and FIG. 2B are diagrams of a $NH_3$ introduction pipe according to an embodiment of the present invention.
Figure 2B:
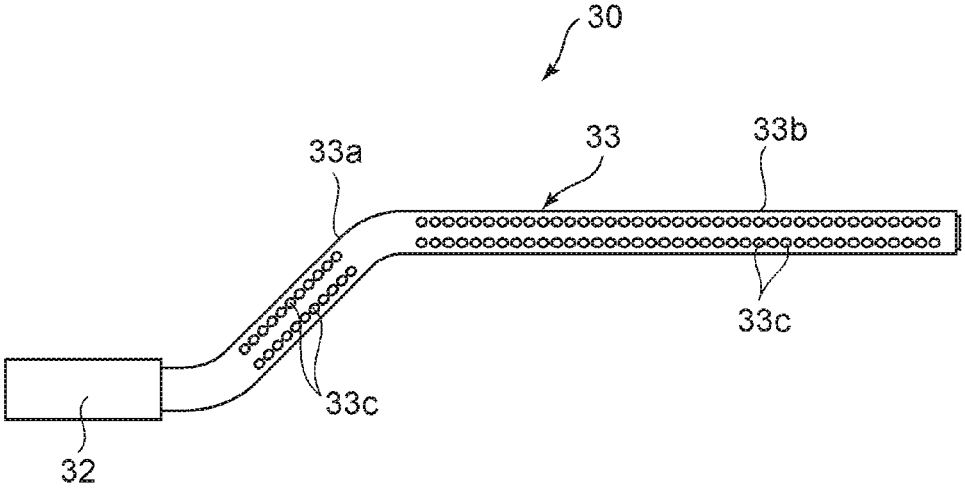

The $NH_3$ spray pipe 33 is disposed substantially parallel along an upper wall 5*b* of the hollow container 5. As shown in FIG. 2A and FIG. 2B, the $NH_3$ spray pipe 33 includes a short-axis spray pipe 33*a* extending bended from the $NH_3$ introduction pipe 32, and a long-axis spray pipe 33*b* extending bended from an end portion of the short-axis spray pipe 33*a*. A plurality of spray holes 33*c* having a small diameter are formed in two rows in the axial direction of the spray pipes, on the lower faces of the short-axis spray pipe 33*a* and the long-axis spray pipe 33*b*. The spray holes 33*c* are formed to face downward.

On the upper part of the side wall 5*c* of one end side of the hollow container 5, as shown in FIG. 1A and FIG. 1B, a $NH_3$ lead-out opening 41 is formed, and the $NH_3$ discharge pipe 40 is inserted into the $NH_3$ lead-out opening 41. The $NH_3$ discharge pipe 40 extends to a position close to the inner surface of a side wall 5*d* on the opposite end side of the hollow container 5 along the axial direction of the hollow container 5, and has an opening portion 40*a* formed on the opposite end portion of the $NH_3$ discharge pipe 40. Thus, the vaporized NH3 refrigerant gas flows out from the $NH_3$ discharge pipe 40 via the opening portion 40*a*.

A $CO_2$ introduction opening 50 is disposed in the center part of the side wall 5*c* of the hollow container 5. A $CO_2$ introduction pipe 51 is inserted into the $CO_2$ introduction opening 50. The $CO_2$ introduction pipe 51 is in communication with a $CO_2$ introduction hole 13 formed inside the plate stack 10.

A $CO_2$ lead-out opening 53 is formed on the side wall 5*c* on a side of the hollow container 5 below the $CO_2$ introduction pipe 51. A $CO_2$ lead-out pipe 54 is inserted into the $CO_2$ lead-out opening 53. The $CO_2$ lead-out pipe 54 is in communication with a $CO_2$ lead-out hole 15 formed inside the plate stack 10.

Figure 3:
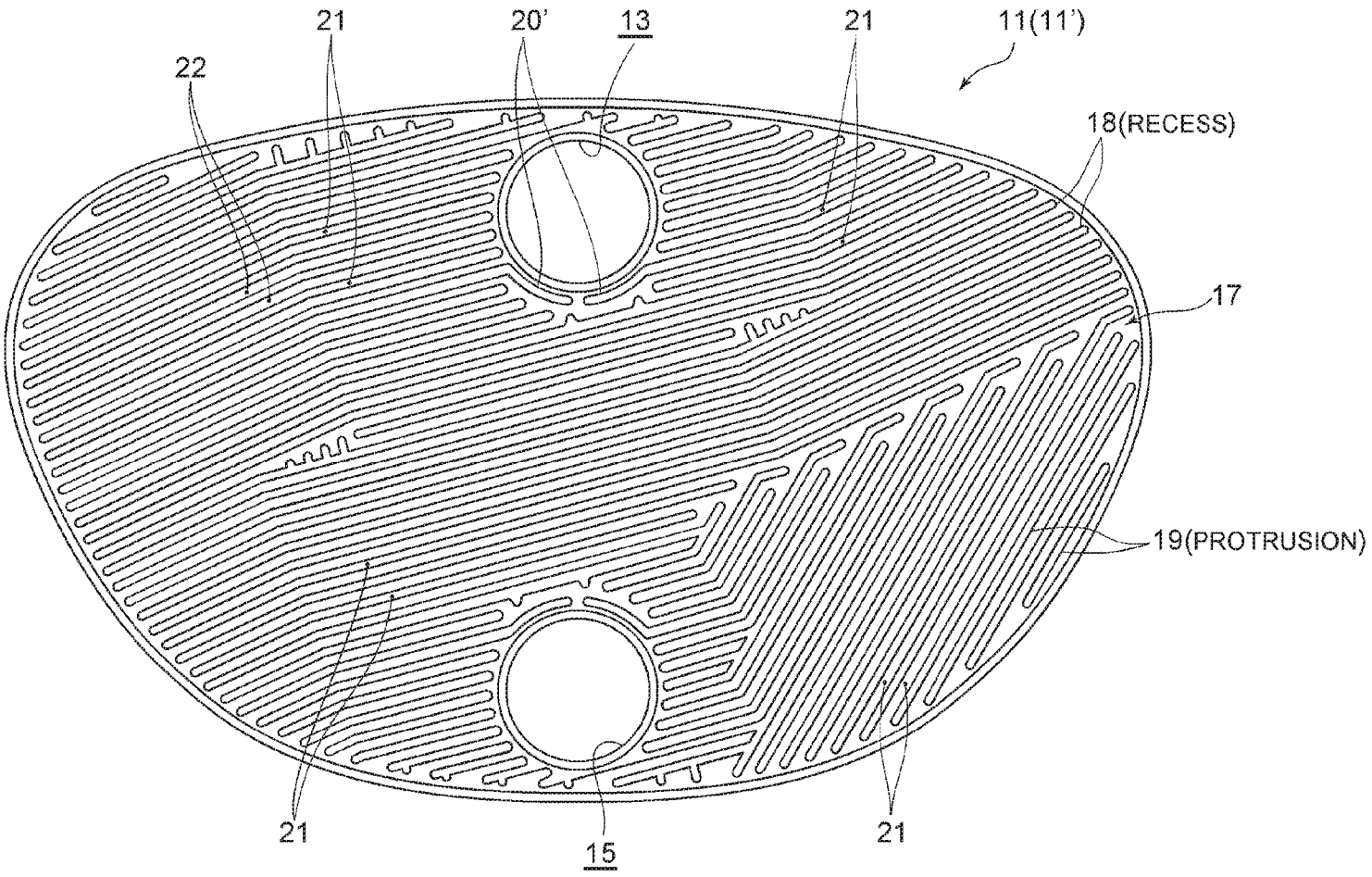
FIG. 3 is a front view of a plate according to an embodiment of the present invention.

The plates 11 forming the plate stack 10 are formed of sheet metal (e.g. stainless steel sheet). As shown in FIG. 1B and FIG. 3, in the axial directional view of the hollow container 5, the plates 11 are formed asymmetrically in the vertical direction with respect to the horizontal line H passing through the axial center S of the hollow container 5. That is, the plate 11*a* below the axial center S of the hollow container 5 is formed into a semi-circular shape along and adjacent to an inner wall surface 5*e* of the hollow container 5, the plate 11*a* having a curvature radius centered at a position below the axial center S of the hollow container 5. Furthermore, the plate 11*b* above the axial center S of the hollow container 5 is formed into a flattened shape (semi-oval shape), the plate 11*b* having a curvature radius greater than the curvature radius centered at the axial center S of the hollow container 5.

Figure 4:
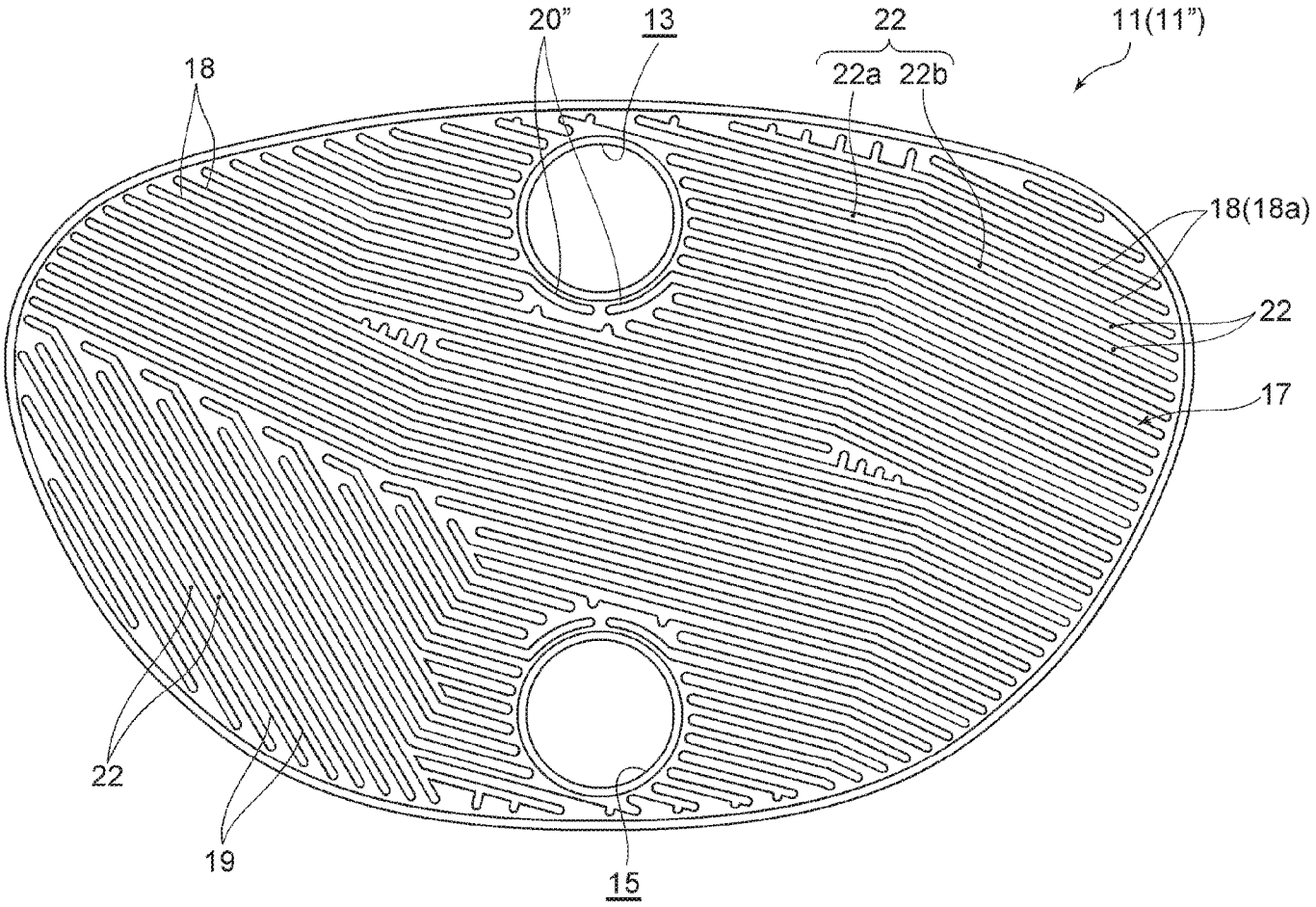
FIG. 4 is a front view of the plate in FIG. 3 turned over and showing the opposite side.

As shown in FIG. 3 and FIG. 4, each of the plates 11 forming the plate stack 10 has a plurality of concavo-convex portions 17 formed on a front side and a back side of the plate 11. The plate stack 10 includes the plate 11' shown in FIG. 3 and the plate 11" shown in FIG. 4 stacked alternately. The plate 11" shown in FIG. 4 is the opposite side of the plate 11' shown in FIG. 3. Accordingly, the plate 11" shown in FIG. 4 has a configuration similar to that of the plate 11' shown in FIG. 3, and thus the plate 11" shown in FIG. 4 is associated with the same reference numerals as FIG. 3 at the same features to simplify the description.

As shown in FIG. 3, the $CO_2$ introduction hole 13 having a circular opening is disposed on the upper center part, in the width direction, of the plate 11'. The $CO_2$ lead-out hole 15 having a circular opening is disposed on the lower center part, in the width direction, of the plate 11'.

The concavo-convex portions 17 include a plurality of recessed portions 18 extending linearly and inclined (at an inclination angle of approximately 25 degrees) diagonally to the upper right side, formed in a region excluding the lower right section on the surface of the plate 11', and a plurality of protruding portions 19 extending linearly and diagonally to the upper right side having a greater inclination angle (approximately 60 degrees) than the recessed portions 18, formed in a region at the lower right section of the plate 11'. The plurality of recessed portions 18 are formed parallel to one another at a predetermined interval, and the plurality of protruding portions 19 are formed parallel to one another at a predetermined interval.

When the plate 11" shown in FIG. 4 is stacked on the opposite side of the plate 11' shown in FIG. 3, two independent heat exchange flow passages are formed on the front side and the back side of the plates 11', 11": the first heat exchange flow passage 21 and the second heat exchange flow passage 22. The first heat exchange flow passage 21 is formed on the front side of the plate 11' shown in FIG. 3, extending toward the right end portion, in the width direction, of the plate 11', upward from the $CO_2$ lead-out hole 15. The first heat exchange flow passage 21 is formed by the valley between adjacent protruding portions 19 of the concavo-convex portions 17, and by grooves inside the recessed portions 18. Thus, the first heat exchange flow passage 21 is formed as a flow passage facing obliquely upward from one side toward the other side in the width direction of the plate 11'.

Furthermore, the second heat exchange flow passage 22 is formed on the front side of the plate 11" shown in FIG. 4, extending and bending toward the right side portion and the left side portion of the plate 11" downward from the $CO_2$ introduction hole 13, and extending toward the $CO_2$ lead-out hole 15 downward. The second heat exchange flow passage 22 is formed by the valley between the projecting portions 18*a*, projecting toward the bottom surface side, of the recessed portions 18 of the plate 11" shown in FIG. 4 and the valley between the protruding portions 19 shown in FIG. 3, and by the valley between the projecting portions 18*a*, protruding toward the bottom surface side, of the recessed portions 18 of the plate 11' shown in FIG. 3 and the valley between the protruding portions 19 of the plate 11" shown in FIG. 4.

The second heat exchange flow passage 22 includes a condensing flow passage 22*a* extending linearly toward the side portion of the plate 11" downward and a discharge flow passage 22*b* extending linearly toward the $CO_2$ lead-out hole 15 downward. Furthermore, the inclination angle in the extending direction of the condensing flow passage 22*a* is smaller than the inclination angle of the extending direction of the discharge flow passage 22*b*. Thus, the flow of the $CO_2$ gas refrigerant supplied from the $CO_2$ introduction hole 13 is slow at first, and then gets faster. Thus, it is possible to enhance the effect to transmit heat to the $NH_3$ refrigerant liquid from the $CO_2$ gas refrigerant, and to let the cooled $CO_2$ refrigerant liquid flow through the $CO_2$ lead-out hole 15 quickly. Accordingly, it is possible to provide a refrigerant heat exchanger 1 having a high heat-transmitting efficiency.

Further, a restriction concavo-convex portion 20' for restricting downward movement of the $CO_2$ gas refrigerant supplied from the $CO_2$ introduction hole 13 is formed below the $CO_2$ introduction hole 13 formed on the plate 11' shown in FIG. 3. The restriction concavo-convex portion 20' is formed into an arc shape so as to surround the outer periphery of the lower part of the $CO_2$ introduction hole 13. The restriction concavo-convex portion 20' is formed into a protruding shape as seen from the back side of the plate 11'.

Further, a restricting concavo-convex portion 20" is formed below the $CO_2$ introduction hole 13 formed on the plate 11" shown in FIG. 4. This restriction concavo-convex portion 20" is formed in an arc shape so as to surround the outer periphery of the lower part of the $CO_2$ introduction hole 13, and has a protruding shape as seen from the front side of the plate 11". When the plates 11', 11" are stacked, the bottom portions of the restriction concavo-convex portion 20' shown in FIG. 3 and the restriction concavo-convex portion 20" of the plate 11" shown in FIG. 4 make contact, and an arc-shaped wall is formed below the $CO_2$ introduction hole 13. Thus, it is possible to restrict downward movement of the $CO_2$ gas refrigerant supplied from the $CO_2$ introduction hole 13. Thus, it is possible to forcedly move the flow of the $CO_2$ gas refrigerant supplied from the $CO_2$ introduction hole 13 outward in the width direction of the plates 11', 11", and thereby it is possible to prevent a decrease in the heat-transmitting efficiency in advance.

The above plates 11', 11" are integrated by connecting the outer peripheries of a plurality of plates 11', 11" by welding or the like while the plates 11', 11' are in a stacked state. The concavo-convex portions 17 are formed by press processing.

In the refrigerant heat exchanger 1 with the above configuration, the $CO_2$ gas refrigerant supplied from the $CO_2$ introduction pipe 51 flows through the second heat exchange flow passage 22 of the plates 11', 11", and exchanges heat with the $NH_3$ liquid refrigerant flowing through the first heat exchange flow passage 21 to become the $CO_2$ refrigerant liquid, before flowing out of the $CO_2$ lead-out pipe 54 via the second heat exchange flow passage 22.

As described above, with the refrigerant heat exchanger 1, the second heat exchange flow passage 22 is configured to extend and bend toward the end portion, in the width direction, of the plates 11', 11" downward from the $CO_2$ introduction pipe 51, as seen in the plate-stacking direction, and to extend toward the $CO_2$ lead-out hole 15 downward, while the first heat exchange flow passage 21 is configured to extend toward the end portion, in the width direction, of the plates 11', 11" upward from the $CO_2$ lead-out hole 15, as seen in the plate-stacking direction. Thus, both of the first heat exchange flow passage 21 and the second heat exchange flow passage 22 have a simple structure. Accordingly, the structure of the refrigerant heat exchanger 1 is simplified, and it is possible to provide a refrigerant heat exchanger 1 capable of suppressing an increase in the production costs.

Furthermore, when stacking adjacent plates 11', 11", the first heat exchange flow passage 21 and the second heat exchange flow passage 22 are formed by the valley between the protruding portions 19 of the adjacent concavo-convex portions 17 and the grooves inside the recessed portions 18, which makes it possible to further facilitate production of the refrigerant heat exchanger 1.

Figure 5A:
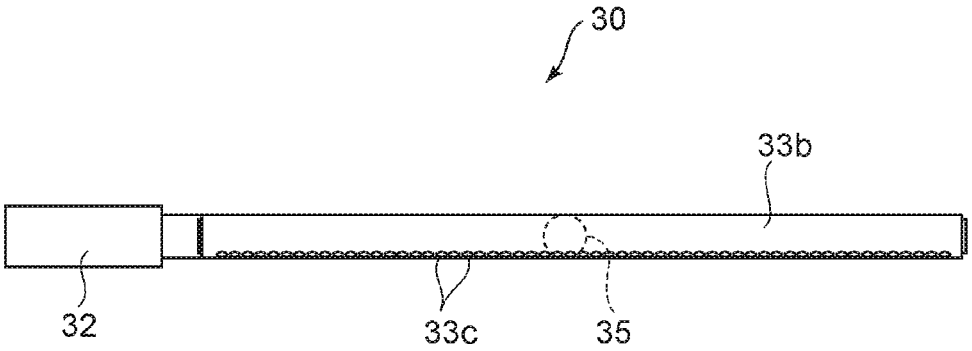
FIG. 5A and FIG. 5B are diagrams of a $NH_3$ introduction pipe according to another embodiment.
Figure 5B:
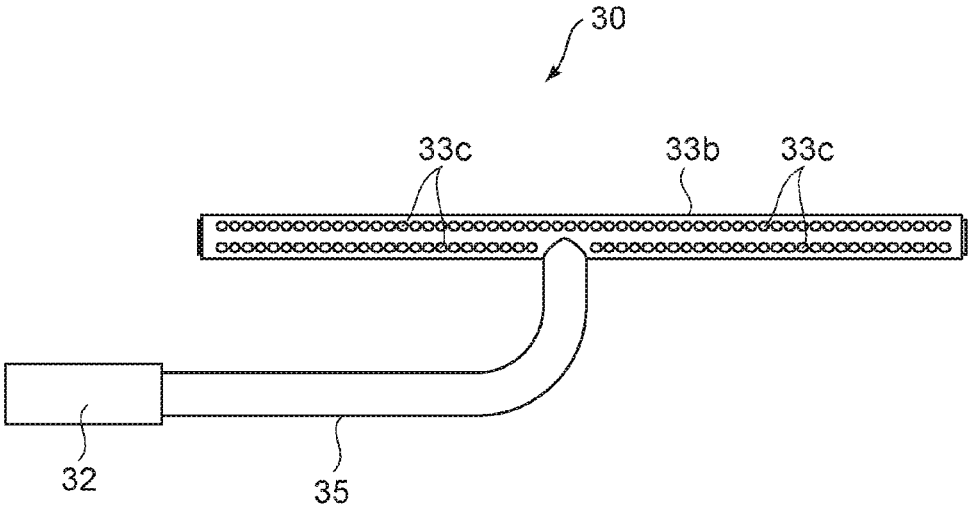

Furthermore, while the above described embodiment includes the $NH_3$ spray pipe 33 having the short-axis spray pipe 33*a* extending and bending from the $NH_3$ introduction pipe 32 and the long-axis spray pipe 33*b* extending and bending from an end portion of the short-axis spray pipe 33*a* (see FIG. 2B), a communication pipe 35 capable of supplying the $NH_3$ liquid refrigerant and in communication with the $NH_3$ introduction pipe 32 may be connected to the intermediate section, in the longitudinal direction, of the long-axis spray 33*b* having substantially the same length as the axial direction of the plate stack 10, as shown in FIG. 5A and FIG. 5B. With this configuration, the $NH_3$ liquid refrigerant can be supplied even more uniformly to the plate stack 10.

The invention claimed is:

1. A refrigerant heat exchanger, comprising:

a hollow container, having a cylindrical shape;

a plate stack, disposed on an inner lower side of the hollow container, and the plate stack including: plates, each having a front side and a back side with a plurality of concavo-convex portions formed thereon, and the plates are stacked to form a plurality of first heat exchange flow passages through which a first refrigerant flows and a plurality of second heat exchange flow passages through which a second refrigerant flows;

a supply pipe, disposed in an interior space of the hollow container above the plate stack and configured to supply the first refrigerant to the plate stack; and a discharge pipe, configured to exchange heat between the first refrigerant supplied from the supply pipe and the second refrigerant flowing through the plate stack and to discharge the first refrigerant, wherein a lower side of the plates of the plate stack has a semi-circular shape along and adjacent to an inner wall surface of the hollow container, wherein an upper side of the plates has a flattened shape having a greater curvature radius than a curvature radius of the semi-circular shape, wherein a second introduction hole which extends in a plate-stacking direction and into which the second refrigerant is introduced is disposed in an upper portion of the plate stack, and a second lead-out hole which extends in the plate-stacking direction and from which the second refrigerant is led out is disposed in a lower portion of the plate stack, wherein each of the second heat exchange flow passages comprises: a condensing flow passage extending linearly toward a side portion of the plates downward from the second introduction hole, in a view in the plate-stacking direction; and a discharge flow passage connected with the condensing flow passage via a bend portion and extending linearly toward the second lead-out hole downward, in the view in the plate-stacking direction, wherein the first heat exchange flow passage is formed so as to extend toward an end portion, with respect to a width direction, of the plates upward from the second lead-out hole, in the view in the plate-stacking direction, wherein an inclination angle of an extending direction of the condensing flow passage is smaller than an inclination angle of an extending direction of the discharge flow passage, and wherein the condensing flow passages of two or more of the second heat exchange flow passages are arranged one above the other between the second introduction hole and the second lead-out hole positioned below the second introduction hole.

2. The refrigerant heat exchanger according to claim 1, wherein the plate stack is configured such that, when the concavo-convex portions formed on respective adjacent plates are in contact with each other, the first heat exchange flow passages and the second exchange flow passages are formed by a corresponding valley between protruding portions of the adjacent concavo-convex portions and by a corresponding groove inside a recessed portion.

3. The refrigerant heat exchanger according to claim 1, wherein a restriction concavo-convex portion for restricting downward movement of the second refrigerant supplied from the second introduction hole is formed below the second introduction hole formed on the plates.

* * * * *